US009596972B2

(12) United States Patent
Sonoda

(10) Patent No.: US 9,596,972 B2
(45) Date of Patent: Mar. 21, 2017

(54) METHOD AND APPARATUS FOR CLEANING VESSELS

(71) Applicant: Naoki Sonoda, Palatine, IL (US)

(72) Inventor: Naoki Sonoda, Palatine, IL (US)

( * ) Notice: Subject to any disclaimer, the term of this patent is extended or adjusted under 35 U.S.C. 154(b) by 192 days.

(21) Appl. No.: 14/089,695

(22) Filed: Nov. 25, 2013

(65) Prior Publication Data

US 2014/0283877 A1 Sep. 25, 2014

Related U.S. Application Data

(60) Provisional application No. 61/729,644, filed on Nov. 26, 2012.

(51) Int. Cl.

| | |
|---|---|
| ***B08B 9/00*** | (2006.01) |
| ***B08B 3/12*** | (2006.01) |
| ***A47L 15/00*** | (2006.01) |
| ***B08B 3/02*** | (2006.01) |

(52) U.S. Cl.
CPC ..... *A47L 15/0065* (2013.01); *B08B 3/02* (2013.01)

(58) Field of Classification Search
None
See application file for complete search history.

(56) References Cited

U.S. PATENT DOCUMENTS

| | | | | |
|---|---|---|---|---|
| 708,844 A | | 9/1902 | Sweeney | |
| 737,247 A | | 8/1903 | Kammerer | |
| 784,755 A | | 3/1905 | Pein | |
| 1,075,734 A | | 10/1913 | Smith | |
| 1,337,303 A | | 4/1920 | Young | |
| 1,433,337 A | | 10/1922 | Boesser | |
| 1,460,094 A | | 6/1923 | Cunneen | |
| 2,251,059 A | | 7/1941 | Lau | |
| 2,691,986 A | * | 10/1954 | Kirby | A47L 15/23 134/107 |
| 2,723,894 A | * | 11/1955 | Bartleson | A47B 77/14 312/210 |

(Continued)

FOREIGN PATENT DOCUMENTS

| | | |
|---|---|---|
| DE | 0488976 | 1/1930 |
| DE | 1750535 | 3/1971 |

(Continued)

OTHER PUBLICATIONS

Espresso Parts; Counter Top Rinser; Internet sales literature; circa 2014, USA http://www.espressoparts.com/EPPRCT662.

American Beverage; Stainless Steel Drip Tray w/ Rinser; Internet sales literature;circa 2014, USA http://rapidswholesale.com/american-beverage-ss-drip-tray-w-rinser-24-w-x-7-d.html?gclid=CLyn_8fet7wCFQsSMwodPEYAjA.

(Continued)

*Primary Examiner* — Eric Golightly
*Assistant Examiner* — Arlyn I Rivera-Cordero

(57) ABSTRACT

An apparatus for rinsing vessels such as but not limited to those used for drink preparation at a bar may include a splash-resistant enclosure within which vessels are rinsed. A nozzle assembly disposed within the stall and coupled to a supply of rinsing media is configured to direct a spray of rinsing media simultaneously at an interior surface and an exterior surface of a vessel to be rinsed when placed within the stall. A method of rinsing such vessels includes simultaneously directing a flow of rinsing media at an interior and an exterior of the vessel in a predetermined quantity and/or for a predetermined time.

18 Claims, 2 Drawing Sheets

(56) References Cited

U.S. PATENT DOCUMENTS

| | | | | |
|---|---|---|---|---|
| 3,595,253 | A * | 7/1971 | Yanez-Pastor | A47L 15/0089 134/105 |
| 4,768,534 | A * | 9/1988 | Anderson | A47L 15/0086 134/175 |
| 4,836,230 | A * | 6/1989 | Elliott | A47L 15/0089 134/138 |
| 6,092,540 | A * | 7/2000 | Chiao | A47L 15/0089 134/115 R |
| 6,863,231 | B2 | 3/2005 | Schaefer | |
| 7,104,474 | B2 | 9/2006 | Katz et al. | |
| 2010/0012163 | A1* | 1/2010 | Alpert | A47L 15/0089 134/58 D |

FOREIGN PATENT DOCUMENTS

| | | |
|---|---|---|
| FR | 2543426 | 3/1985 |
| GB | 191413781 | 0/1914 |
| GB | 0209943 | 1/1924 |
| GB | 0309878 | 4/1929 |
| GB | 0330249 | 6/1930 |
| GB | 0645731 | 11/1950 |

OTHER PUBLICATIONS

Blendtec; Rapid Rinser Sprayer; Internet sales literature; circa 2014, USA http://restauranttory.com/blendtec-rapid-rinser-sprayer-900059.asp.

* cited by examiner

METHOD AND APPARATUS FOR CLEANING VESSELS

CROSS-REFERENCE TO RELATED APPLICATIONS

This patent claims priority to U.S. Provisional Patent Application Ser. No. 61/729,644 filed Nov. 26, 2012, the disclosure of which is hereby expressly incorporated herein for all purposes.

TECHNICAL FIELD

This patent relates to the cleaning of various vessels or containers such as but not limited to pieces of barware, and in particular, to an apparatus and associated method for quickly, thoroughly and without operator intervention or supervision cleaning drink, mixing and other vessels.

BACKGROUND

As cocktail drinkers' palettes have become more sophisticated, their demand for cocktails with sophisticated recipes has continued to rise. Today's martinis and cocktails require increased use of fresh ingredients such as mint and fresh fruit, as well as flavored syrups and dairy products. This trend makes rinsing and cleaning shaker tins even more time consuming, but all the more necessary to provide purity and consistency in cocktails. Before this trend in cocktail recipe sophistication, a martini was considered either vodka or gin with a dash of vermouth. Today, the definition of a martini has become anything that can be shaken with ice and strained into a martini glass.

Typically, stainless steel shaker tins are of limited supply in bars, and at a certain point during a shift, need to be cleaned so that they can be used to make more cocktails. Even if a bar is heavily stocked with shaker tins, there will always be a need to clean and reuse those tins during a shift, many times over.

By making bartenders more efficient, owners will see that they can cut down on labor. One bartender will certainly not be able to do the work of two, but bartenders will become more efficient individually, which will undoubtedly influence owners' and managers' staffing decisions in favor of having less labor on hand versus more. In other words, owners and managers will be able to have more confidence in having less bar staff on hand due to increased efficiency An easy to use, self-operating apparatus and a method of using this apparatus to prepare cleaned and sanitized barware can accomplish the above aims.

DETAILED DESCRIPTION

A device in accordance with the various described embodiments, which include combinations of the various elements and devices herein described, provides for automatically rinsing of the interior and exterior of a vessel, that is, all surfaces of the vessel, such as, for example, mixing glasses and shaker tins that are used to make cocktails with clean tap water. The device may be used to rinse other barware including drinking glasses, carafes, pitchers, decanters and the like. The device in various embodiments operates solely on water pressure, requires no electricity (apart from electricity used to condition and deliver water to the device) and is user-installable. Alternatively, a pressurized supply of water, cleaning agent and/or sanitizing agent or combinations of water, cleaning agent and sanitizing agent may be used to rinse vessels.

After shaking a cocktail, the bartender places the mixing glass and shaker tin upside down on a platform and presses a button to actuate a self-metered valve. Within a period of between perhaps 5 and 15 seconds or longer and preferably approximately about 7 to 10 seconds, the device rinses all surfaces of the glass and shaker tin. The user can easily adjust the duration of the rinse cycle by adjustment of the self-metered valve with or without commonly available tools.

Figure 1:
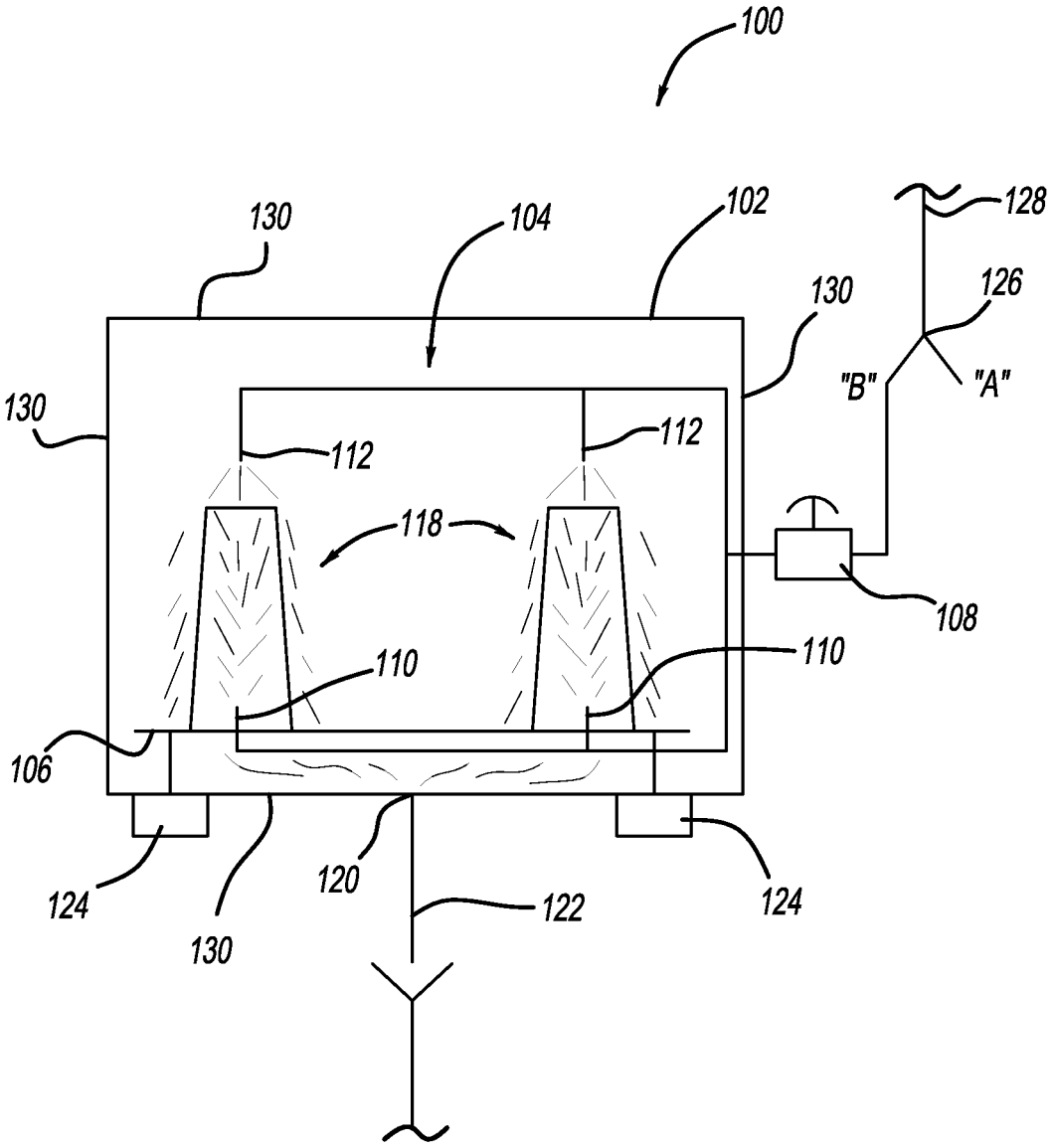
FIG. 1 is a schematic depiction an apparatus for cleaning vessels in accordance with the herein described inventive embodiments.

As shown schematically in FIG. 1, the device 100 may include a shell or housing structure 102, and for example, a stainless steel stall is a suitable structure although composite plastic materials, or other suitable food service grade materials may be used to form the stall. The stall 102 may be mounted on a speed rack (e.g., the type of shelving found in virtually every bar that store liquor bottles for easy access). The stall additionally may be defined by a sink such as are typically installed in a bar or other service area. The stall 102 is designed to enclose and contain splashing, and also can be used to discard ice used to make martinis and other cocktails (it is not intended to be used as a "dump sink," which may require compliance with various health code standards). The stall includes a drain 120 that couples by a piece of flexible hose 122 and empties to a suitable water drain, such as a main floor drain. Alternatively, the stall 102 may be placed on a countertop. This is made possible with an optional countertop kit, which may include an optional base 124 and a suitable drain fitting, e.g., a 90-degree drain fitting, allowing the device to be used in a variety of configurations (not depicted in FIG. 1). In yet another embodiment, the stall 102 may be mounted under surface of the bar or other counter or work surface. In still another alternative embodiment, the top surface of the stall may be fitted with and include a drying or draining rack. This arrangement of the stall 102 allows placement of freshly rinsed vessels on the rack on the top surface of the stall 102 to drain excess water and dry. The top surface of the stall 102 may optionally be contoured to guide water draining from the rinsed vessels to a drain formed in the top surface or adjacent to the top surface to collect the drained water and guide it either into the stall 102 to communicate with the drain or separately to the drain. In still another embodiment, the draining or drying rack may extend below the stall 102 and include suitable connections to the drain.

While vessels are being rinsed, the bartender can begin completing other tasks, such as making cocktails for wait staff, tending to guests, washing glassware—whatever the task may be. This increase in bar staff productivity works to increase the productivity of the entire front of house staff, thereby making the entire restaurant operation more efficient. Most importantly, customer wait time is decreased, which increases the chances of a positive dining experience.

Exemplary Operation

The rinsing process of the device 100 is made possible by a system of opposing nozzles 104 positioned to clean both the inside and outside surfaces of mixing glasses and shaker tins. The user places a glass and shaker tin upside down on a platform 106 that is perforated to allow rinse water to pass through. The user then actuates a self-metered water valve 108 to begin the cleaning cycle. A pair of upward-pointing jets 110 spray a metered amount of water 118 to rinse the inside of the mixing glass and shaker tin, while a pair of downward-pointing jets 112 rinse the outside surfaces, thereby thoroughly and completely rinsing all surfaces of the glassware. The flow from the downward-pointing jets 112 may optionally be configured to stabilize the glass or shaker tin being rinsed against the simultaneous upward flow from the jets 100 rinsing the interior of the glass or shaker tin. The downward flow may be greater in volume and/or pressure to ensure the glass or shaker tin does not move within the stall or is displaced from the platform by the upward flow. However, in many instances the pressure of the rinsing flow may be selected such that it is not sufficient to displace the vessels being rinsed. To limit splashing from the downward-pointing jets 112, an optional check valve or line restriction may be used. The check valve prevents splashing of the downward pointing spray jets when the user actuates the self-metered valve. The check valve or restriction may be located within the line that delivers water to both downward-pointing jets. The nozzles 104 and corresponding jets 110 and 112 may be disposed in a fixed position.

Two of these pairs of upward and downward oriented nozzles 104 may be located next to one another, creating a glass cleaning "station," allowing both parts of a cocktail shaker to be cleaned simultaneously. After a cleaning cycle has been completed (which may be user configurable from about 5 to about 15 and preferably about 7-10 seconds), both the glass and shaker tin are completely rinsed and ready for use. The device 100 automates the task of rinsing mixing glasses and shaker tins, which saves valuable time throughout a service shift. Seconds are extremely valuable in the restaurant business, and seconds saved can lead to minutes saved. Extended wait periods create frustration among servers, and ultimately, customers. The device 100 functions to make the process of cocktail delivery and customer service more efficient, timely, and less stressful.

The device 100 allows bartenders to continue making cocktails without the interruption of having to rinse their shaker tins manually, while ensuring that the residues from the previous drink will not contaminate the flavor, purity, or appearance of the next drink. By eliminating the step of having to clean mixing glasses and shaker tins manually, bartenders now have more time to complete other tasks. No longer do bartenders have to waste time hand washing equipment, or wait for an automatic glass washing machine to cycle and cool down to have a clean mixing glass and shaker tin available. By increasing the overall efficiency of bartenders and front of house service staff, device 100 is a value-adding tool that will become indispensable.

The device 100 also functions to rinse and clean jiggers and shot glasses, which many bar owners require for portion control purposes. For example, a jigger used to measure scotch whiskey would need to be cleaned and rinsed before it is used to measure vodka. If the jigger is not clean, it will contaminate the flavor of the next drink. Contamination of beverages leads to inventory wastage and longer wait times, but most importantly, a potentially dissatisfied customer.

Figure 2:
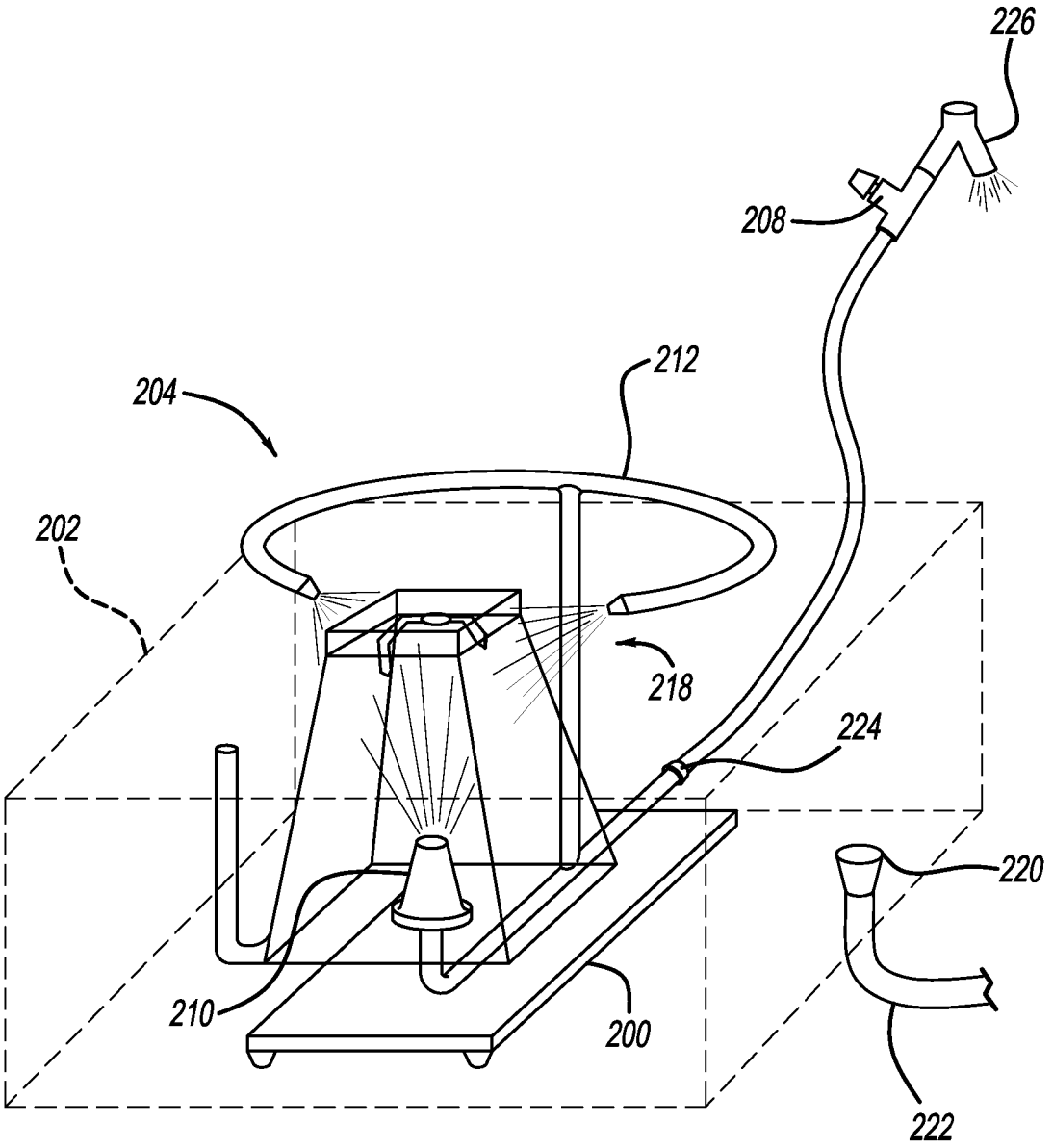
FIG. 2 is a schematic depiction of an apparatus for cleaning vessels in accordance with an alternate of the herein described inventive embodiments.

FIG. 2 depicts an alternative embodiment of a device, device 200, that incorporates a system of opposing nozzles 204 positioned to clean both inside and outside surfaces of vessels, such as pitchers, glasses, mixing glasses, shaker tins and the like. In this embodiment, the system 204 is adapted to be disposed within a sink (depicted as 202 in phantom in FIG. 2), and thus is capable of operating without the stall structure of the embodiment shown in FIG. 1, As shown in FIG. 2, the rinsing process of the device 200 is made possible by a system of opposing nozzles 204 positioned to clean both the inside and outside surfaces of vessels. The user places a vessel upside down on a platform 206 that is perforated to allow rinse water to pass through. The user then actuates a self-metered water valve 208 to begin the cleaning cycle. An upward-pointing jet 210 sprays a metered amount of cleaning media, such as water, 218 to rinse the inside of the vessel, while a pair of downward-pointing jets 212 rinse the outside surfaces, thereby thoroughly and completely rinsing all surfaces of the vessel. The cleaning media is communicated from the sink via the drain fitting 220 and drain line 222. A quick connect valve 224 may be provided allowing the nozzle system 204 to be easily installed into or remove from the sink 202. The nozzles 204 and jets 210 and 212, once positioned within the sink, may be disposed in a fixed position.

Sanitary Benefits

Oftentimes, bartenders use hand wash sinks to clean mixing glasses and shaker tins, which is a potentially unsanitary practice. Bartenders are known for simply leaving shaker tins and mixing glasses in a hand wash sink, while they complete higher-priority tasks. In such a scenario, any number of contaminants can come into contact with the shaker tins and glasses. For example, another employee may need to wash their hands, and they will be doing so while the shaker tin is lying at the bottom of a hand wash sink. Unless equipment is now properly sanitized, there is potential for contamination. If used properly, the devices 100 and 200 eliminate the possibility of any contamination, as it is housed in a separate stall, completely isolating the mixing glass and shaker tin.

Installation

The devices 100 and 200 are respectively connected to a clean water supply 128 via any faucet (typically a faucet dedicated to a hand wash sink) with the included connection kit. This connection kit contains a faucet adapter that splits the main stream of water in to 2 streams via a "Y" joint or splitting joint 126/226 (indicating the operable element of the device 100 or the device 200, as the case may be, and this convention is repeated throughout). The first stream (A) feeds water to an aerator that allows the faucet to continue to be used for normal tasks such as hand washing, rinsing of containers, etc. Stream A will have an on/off valve and act as a typical faucet. The second stream (B) supplies water to the device 100/200, and will be activated with the self-metering valve 108/208. The faucet to which the device 100/200 is connected will have its main valves fully open at all times during use to facilitate its operation. At the end of a shift, the user can turn the main faucet off and clean the unit.

The device 100, as noted, includes a stainless steel stall 102 to contain any splashing that may occur during a cleaning cycle. This stall includes an aperture to allow access to the cleaning stations/nozzles 104, and is configured with a top, bottom and side walls 130 to contain splashing. The stall 102 contains a drain 120 in the bottom, which couples via a flexible hose 122 to empty to any suitable drain, such as a main floor drain. In addition, the stall 102 functions to receive left over drink and ice used to make a cocktail, which can be quickly dumped before the cleaning process. The cleaning process itself melts the discarded ice. The device 200, as noted, may be installed within a sink 202, without modification of the sink.

Installation of the device 100/200 does not require any sort of alteration to existing plumbing, unless the user prefers to do so. The major drawback of a "hard" installation is that cleaning and maintenance is made to be slightly more difficult because the user will have to shut off the dedicated water supply in order to disassemble the unit for cleaning.

Other Uses

With a few, slight alterations, the same technology employed in the device 100/200 can be used in other food service environments, namely: coffee houses, juice bars, ice cream parlors, and busy kitchens.

Cleaning Wine Decanters

The technology of the device 100/200 can be used to quickly clean wine decanters, which are often in short supply in restaurants. Service staff often choose not to decant wine because they see it as a hassle (unless the bottle of wine is very expensive). When decanters are used, they are often cleaned in hand wash sinks, which can be an unsanitary practice, as well as a waste of water. The device 100/200 can be used as-is or easily modified as necessary by adjustment of the nozzles 104/204 to create an automatic decanter rinser. The device 100/200 so modified would encourage the use of decanters (which impresses customers) and would keep decanters clean and ready for use.

Cleaning Blender Pitchers (Coffee Houses)

Baristas in coffee houses would benefit from the technology of the device 100/200 in the same way that bartenders would, but in two different ways. Instead of focusing on cleaning glass/shaker tin pairings, the same technology used in the device 100/200 can be employed to clean blender pitchers in coffee houses. Instead of having 2 glass-cleaning "stations," a device 100 so modified may consist of a single cleaning station to clean pitchers used in coffee houses to make frozen drinks, as depicted in FIG. 2.

Within the last decade, frozen coffee drinkers—and coffee drinkers in general—have become very specific about how they order their drinks. This trend, in turn, prevents baristas from making large batches of frozen drinks. Instead, they must make each drink to order. Each frozen drink is thereby highly labor and time intensive—similar to the trend that has developed in the bar industry. Like bartenders who must make a wide variety of flavored martinis and cocktails, baristas must make a wide variety of frozen drinks, and must rinse each pitcher to ensure that the next drink they make is free of any residue from the previous drink.

Baristas will often leave dirty pitchers under a running faucet to clean them, which wastes water and is inefficient. By using a modified device 100, coffee house owners would not only see increased efficiency in their operations, their operating costs would decrease as less water is being used to clean pitchers. A modified device 100/200 would allow baristas to start immediately making the next frozen drink instead of having to spend time cleaning each pitcher. Like the device 100/200, a device modified for coffee house use would clean both the inside and outside of the pitcher, ensuring that no residue remains from a previous drink.

Cleaning Blender Pitchers (Juice Bars and Smoothie Shops)

Juice bars and smoothie shops would also benefit from this technology in the same way. Juice bars often stock dozens of blender pitchers because of the many varying drinks they sell, and often assign an employee to the sole task of cleaning these pitchers. A device 100/200 modified as necessary to accommodate the size and shape of the shop pitchers would automate the cleaning process. This cuts down on the number of pitchers and number of employees required, which in turn decreases equipment costs and payroll, respectively.

Advantages

Current pitcher rinsers are inefficient for 2 reasons. The first shortcoming of current pitcher rinser design is that they clean only the inside of each pitcher, which does not ensure that the flavors from one drink do not transfer to the next. This also creates a situation where the user must eventually halt the flow of making drinks to clean the outside of the pitchers, as they will eventually become too soiled and sticky to continue using. The second flaw in current pitcher rinser design is that the user must tend to the pitcher rinser by applying downward pressure to actuate a water valve until the pitcher is completely clean. This addresses the issue of water wastage, but does not increase efficiency. Pitchers are often left unclean because users do not have enough time or patience to wait for current technology to complete the cleaning process.

The device 100/200 solves both of these issues by creating a process that cleans both the inside as well as the outside of the pitcher, and does so automatically, allowing the barista or juice bar employee to complete other tasks while pitchers are being cleaned.

Cleaning Frothing Tins Used For Making Cappuccinos and Lattes

The device 100/200 could also be employed in coffee houses to clean steel milk frothing cups. Instead of having two glass-cleaning stations, as depicted for the device 100/200, there would may be single cleaning station, housed in a stall so it could be placed on a countertop. Current technology exists for this, but again, does not address the issue of cleaning the outside of the frothing cup. Another drawback of existing froth cleaning devices is that the user must apply downward pressure for water to continue flowing, forcing users to tend to the cleaning process until it is complete. The device technology allows baristas to complete other tasks while their frothing cups are being cleaned.

Cleaning Malt Cups and Blender Pitchers in Ice Cream Shops

This same technology would aid in increasing the efficiency of ice cream shops, for the same reasons. More time could be spent taking and completing orders instead of cleaning. Guest turnover rates would also be increased. Increases in workflow efficiency could also decrease the amount of labor needed to staff an operation—another benefit for owners.

Pre-Washing

Equipment used in preparing dairy-based beverages often need to be pre-washed in order not to contaminate wash water when using the 3 sink method of manual ware washing. The device 100/200 and its various modifications would facilitate this, allowing users to keep wash water cleaner for longer periods of time, saving water as well as detergent, which would cut down on operating costs.

Fast Food Restaurants

Fast food restaurants are also increasingly offering frozen drink selections, and would benefit in all of the aforementioned ways.

The Consumer Market

The device 100/200 could also be marketed toward the consumer that uses a blender at home. The popularity of smoothies, blended drinks, and health shakes has potentially created a market for a consumer version of the device 100/200. Many blender owners do not use their blenders because of the hassle of clean up. The at-home version of the device 100/200 or its various modifications would encourage more consumers to use their blenders, and may potentially work to drive sales of consumer-grade blenders.

There is nothing on the market that performs all of the functions device 100/200. This is a new technology for bars and restaurants that will undoubtedly increase efficiency, productivity, and thereby, add value to establishments that employ it.

Technology for rinsing pitchers is being employed in coffee houses, which is designed to facilitate faster cleaning of pitchers. The device 100/200 improves on this current technology in at least two ways.

Automatic Design: Unlike current pitcher rinsers, that require manual operation, the device 100/200 allows the user to clean pitchers automatically with the touch of a button. Current pitcher rinsers require users to actuate the valve that cleans the inside of pitchers, and must continue to press down on the valve until the cleaning process is complete. This causes haste in cleaning, which can leave residue on the inside of the pitcher. More importantly, current pitcher rinsing design is inefficient in that it requires the user to maintain the flow of clean water, keeping them from tending to other tasks. The device 100/200 and its modifications, allow users to start other tasks while their equipment is being cleaned, creating more time for them, increasing the overall efficiency and productivity of an operation.

Complete cleaning, rather than partial: current pitcher rinsers only clean the inside of the pitchers. As each pitcher is reused to make more beverages, the outsides of the pitchers will continue to gather residue from previous drinks (sugar, syrup, coffee, tea, powders) that will eventually force the user to interrupt their flow of making drinks in order to clean the outside of the pitcher. The device 100/200 and its modifications cleans both the inside as well as outside of the pitcher, ensuring consistency in flavor and appearance, as well as saving time. This savings in time allows for a decrease in wait time, which provides for a better experience for the customer. Increased efficiency also translates into less customer dissatisfaction and customer loss due to long wait times.

While the invention is described in terms of several preferred embodiments of a device 100/200 for cleaning shaker tins, glasses, pitchers, decanters, carafes and the like, it will be appreciated that the invention is not limited to such configurations and uses. The inventive concepts may be employed in connection with rinsing and cleaning virtually any type of barware, glassware, and the like.

While the present disclosure is susceptible to various modifications and alternative forms, certain embodiments are shown by way of example in the drawings and the herein described embodiments. It will be understood, however, that this disclosure is not intended to limit the invention to the particular forms described, but to the contrary, the invention is intended to cover all modifications, alternatives, and equivalents defined by the appended claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Unless a claim element is defined by reciting the word "means" and a function without the recital of any structure, it is not intended that the scope of any claim element be interpreted based on the application of 35 U.S.C. §112, sixth paragraph.

I claim:

1. An apparatus for rinsing drink mixing vessels having an exterior surface and an opening to an interior surface, the apparatus comprising:

a stall having top, bottom and side walls defining an interior and a front access aperture in communication with the interior, the access aperture characterized by remaining open during use of the apparatus, and the top being configured as a drain rack;

a nozzle assembly disposed within the interior of the stall and coupled to a supply of rinsing media;

the nozzle assembly configured to direct a spray of rinsing media simultaneously at the interior surface and the exterior surface of the vessel to be rinsed when placed within the stall; and a valve for activating the spray of rinsing media, the valve being self-metering to provide the spray for a predetermined rinsing cycle.

2. The apparatus of claim 1, the stall comprising a sink.

3. The apparatus of claim 1, wherein the nozzle assembly is configured to direct a spray of rinsing media simultaneously at the interior and exterior surfaces of two vessels to be rinsed when placed within the stall.

4. The apparatus of claim 1, the rinsing media comprising water, cleaning agent, sanitizing agent and combinations thereof.

5. The apparatus of claim 1, comprising a base for supporting the stall on a surface.

6. The apparatus of claim 1, the drain rack being in fluid communication with the interior.

7. The apparatus of claim 1, the nozzles assembly including a first jet and a second jet, the first jet and the second jet being fixed within the stall, the first jet being aligned with the opening to direct a spray of rinsing media at the interior surface and the second jet being aligned to direct a spray of rinsing media at the exterior surface.

8. The apparatus of claim 1, comprising a platform disposed within the stall and upon which the vessel may be disposed.

9. The apparatus of claim 8, wherein the platform is configured to support the vessel to be rinsed in an inverted orientation, the nozzle assembly including a first jet aligned with the opening to direct a spray of rinsing media upward through the opening and onto the interior surface of the vessel and a second jet to direct a spray of rinsing media downward onto the exterior surface of the vessel.

10. The apparatus of claim 1, the rinsing media comprising water, the apparatus comprising a coupling to couple the device to a supply of water.

11. The apparatus of claim 10, wherein the coupling comprises a branch connection to allow a flow of rinsing media to the nozzles and a flow of rinsing media to a sink.

12. The apparatus of claim 1, the valve comprising a user actuated, self-metering valve that is operable without a source of electricity, and wherein the predetermined rinsing cycle is between 5 seconds and 15 seconds.

13. The apparatus of claim 12, wherein the valve is user configurable as to the time of the predetermined rinsing cycle and a quantity of flow of the rinsing media.

14. A kit comprising:

a nozzle assembly, a splash-resistant stall having a top, a bottom, back and side walls and a front defined by an access aperture, the top being configured as a drain rack, a rinsing media actuation and self-metering valve disposed on an exterior of the stall and in fluid communication with the nozzle assembly, the valve operable without a source of electricity;

a platform disposed within the stall for supporting at least one vessel to be rinsed;

the nozzle assembly having a first jet being configured to direct a flow of rinsing media directly onto an interior surface of the vessel through an opening in the vessel and a second jet being configured to simultaneously direct a flow of rinsing media at an exterior surface of the vessel;

a first fluid coupling to couple a source of rinsing media to the valve; and a second fluid coupling to couple the stall to a drain for rinsing media disposal.

15. The kit of claim 14, wherein the first fluid coupling comprises a "Y" coupling to provide a first flow of rinsing media to the valve and a second flow of rinsing media to an adjacent sink.

16. A beverage service station comprising:

a plurality of rack assemblies containing containers of drink preparation materials and drink preparation vessels;

a work surface;

a water supply;

a vessel rinsing apparatus disposed on or adjacent the work surface, the rinsing apparatus comprising:

an enclosure defining a splash-resistant stall having an access aperture remaining open during use of the vessel rinsing apparatus and a drain, and a top surface incorporating a drain rack;

a nozzle assembly disposed within the stall and coupled to the water supply;

the nozzle assembly configured to direct a spray of water simultaneously at an interior surface and an exterior surface of a drinks preparation vessel to be rinsed when placed within the stall; and a non-electrical valve for activating and metering the spray of water.

17. The beverage service station of claim 16 comprising a sink disposed within or adjacent the work surface, the water source being coupled to both the vessel rinsing apparatus and the sink.

18. The beverage service station of claim 16, a floor drain disposed adjacent the beverage service station, the drain being coupled to the floor drain.

* * * * *